US007302899B2

(12) United States Patent
Zeiger

(10) Patent No.: US 7,302,899 B2
(45) Date of Patent: Dec. 4, 2007

(54) TILT HELM

(76) Inventor: Donald J. Zeiger, 518 Portside Dr., Sandusky, OH (US) 44870

( * ) Notice: Subject to any disclaimer, the term of this patent is extended or adjusted under 35 U.S.C. 154(b) by 0 days.

(21) Appl. No.: 11/046,395

(22) Filed: Jan. 28, 2005

(65) Prior Publication Data

US 2005/0166819 A1 Aug. 4, 2005

Related U.S. Application Data

(60) Provisional application No. 60/540,701, filed on Jan. 30, 2004.

(51) Int. Cl.
*B63H 25/00* (2006.01)
*B62D 1/18* (2006.01)

(52) U.S. Cl. ..... 114/144 R; 74/493; 280/775

(58) Field of Classification Search ..... 114/144 R, 114/150, 154, 155, 156, 157, 158, 159, 160, 114/161; 74/493; 280/775
See application file for complete search history.

(56) References Cited

U.S. PATENT DOCUMENTS

| | | | | | |
|---|---|---|---|---|---|
| 1,891,208 | A | * | 12/1932 | Schuetz | 74/501.6 |
| 2,267,308 | A | | 12/1941 | Russell | |
| D149,829 | S | | 6/1948 | Mungen | |
| D158,903 | S | | 6/1950 | Sinko | |
| D173,683 | S | | 12/1954 | Sinko | |
| D176,297 | S | | 12/1955 | Whitehouse | |
| D176,298 | S | | 12/1955 | Whitehouse | |
| 2,826,090 | A | * | 3/1958 | Grinnell et al. | 74/493 |
| D185,608 | S | | 6/1959 | Mainzinger | |
| 3,206,998 | A | * | 9/1965 | Hill et al. | 74/494 |
| 3,395,930 | A | * | 8/1968 | Morgan | 280/775 |
| 3,424,473 | A | * | 1/1969 | Morgan | 280/775 |
| 3,487,712 | A | * | 1/1970 | Steiner | 74/493 |
| 3,954,022 | A | * | 5/1976 | Hemens | 74/496 |
| 4,054,102 | A | | 10/1977 | Borst et al. | |
| 4,467,667 | A | * | 8/1984 | Baba | 74/493 |
| 4,531,921 | A | | 7/1985 | Teraura | |
| 5,136,894 | A | * | 8/1992 | Carter et al. | 74/493 |
| 5,139,281 | A | * | 8/1992 | Dzioba | 280/775 |
| 5,676,081 | A | | 10/1997 | Kobelt | |
| 6,282,977 | B1 | | 9/2001 | Satoh | |
| 6,588,354 | B2 | | 7/2003 | Gai | |
| 2001/0042419 | A1 | | 11/2001 | Latz et al. | |

OTHER PUBLICATIONS

IMCO Nevada Advertisement—1 page- document is undated but inventor believes the document is older than Jan. 29, 2003.

(Continued)

*Primary Examiner*—Sherman Basinger
(74) *Attorney, Agent, or Firm*—Zollinger & Burleson Ltd.

(57) ABSTRACT

A tilt helm for use with a boat having a dashboard and a steering system includes a first housing adapted to be mounted in a fixed position with respect to the dashboard and a second housing having a plurality of teeth. The second housing is selectively pivotable with respect to the first housing. A tilt lock is used to hold the second housing in a selected position.

19 Claims, 8 Drawing Sheets

OTHER PUBLICATIONS

IMCO photographs—3 pages- photographs are undated but inventor believes the documents are older than Jan. 29, 2003.

SeaStar Catalog—2 pages- documents are undated but inventor believes the document is older than Jan. 29, 2003.

SeaStar Helms website—4 pages- www.seastarsteering.com—documents are undated but inventor believes the document is older than Jan. 29, 2003.

SeaStar Traditional Tilt Helms Drawing Part #HH5741 / HH5742 / HH5774 -page- www.seastarsteering.com—drawing is undated but inventor believes the document is older than Jan. 29, 2003.

SeaStar Sport Tilt Helms Drawing Part #HH5290 / HH5291 / HH5292—1page- www.seastarsteering.com—drawing is undated but inventor believes the document is older than Jan. 29, 2003.

* cited by examiner

TILT HELM

CROSS REFERENCE TO RELATED APPLICATIONS

This application claims priority from U.S. Provisional Patent application Ser. No. 60/540,701 filed Jan. 30, 2004; the disclosure of which is incorporated herein by reference.

BACKGROUND OF THE INVENTION

1. Technical Field

The present invention generally relates to nautical helms and, more particularly, to nautical tilt helms. Specifically, the present invention relates to an adjustable tilt helm that connects a steering wheel to a hydraulic steering system.

2. Background Information

Various tilt helms exist in the art. Problems with existing tilt helms also exist. The present invention seeks to solve some of these problems while providing an attractive tilt helm that does not need to be covered with a protective boot or molded cover.

One problem with existing tilt helms is that the mechanism for releasing the locking device is difficult to access while the user is driving the vehicle using the tilt helm. The art desires a locking mechanism that is readily accessible.

The art also desires a locking mechanism that securely maintains the selected position of the tilt helm while being subjected to significant shock and vibration forces such as those created when a boat is traveling at a high speed across choppy water.

The art also desires a tilt helm that will not loosen over time as parts frictionally wear together.

The art also desires a tilt helm that is manufactured entirely from a corrosion-resistant material that is also attractive.

The art also desires a tilt helm that aligns the tilt axis with the axis point of the universal steering column.

The art desires a tilt helm that may be used with a standard steering unit.

The art also desires that the tilt helm will allow the steering column to directly engage the standard steering unit without couplers.

BRIEF SUMMARY OF THE INVENTION

The present invention provides a tilt helm that allows the steering wheel of a vehicle to be selectively positioned in any of a plurality of different angles with respect to a dashboard. The tilt helm of the invention allows the steering wheel to be pivoted about a horizontal axis.

In one embodiment, the invention provides a tilt helm that may be readily modified to work with a variety of dashboard thicknesses and a variety of spaces between the steering unit and the dashboard.

In one embodiment, the invention provides a tilt helm that aligns the pivot point of the universal steering column with the tilting axis of the tilt helm.

In one embodiment, the invention provides a tilt helm that is manufactured from stainless steel.

In one embodiment, the invention provides a tilt helm that securely locks its positions to avoid undesired movement.

In one embodiment, the invention provides a tilt helm that uses tapered bushings that reduce friction and allow the connection between the bearing housing and lever housing to be adjusted over time.

In one embodiment, the invention provides a tilt helm having a lever configuration that is secured against vibration forces by positioning the pivot axis of the lever perpendicular to the pivot axis of the tilt helm. The invention provides further security by positioning the spring that holds the locking lever in its engaged position entirely within the lever housing in direct engagement with the lever.

BRIEF DESCRIPTION OF THE SEVERAL VIEWS OF THE DRAWINGS

Similar numbers refer to similar parts throughout the application.

DETAILED DESCRIPTION OF THE INVENTION

Figure 1:
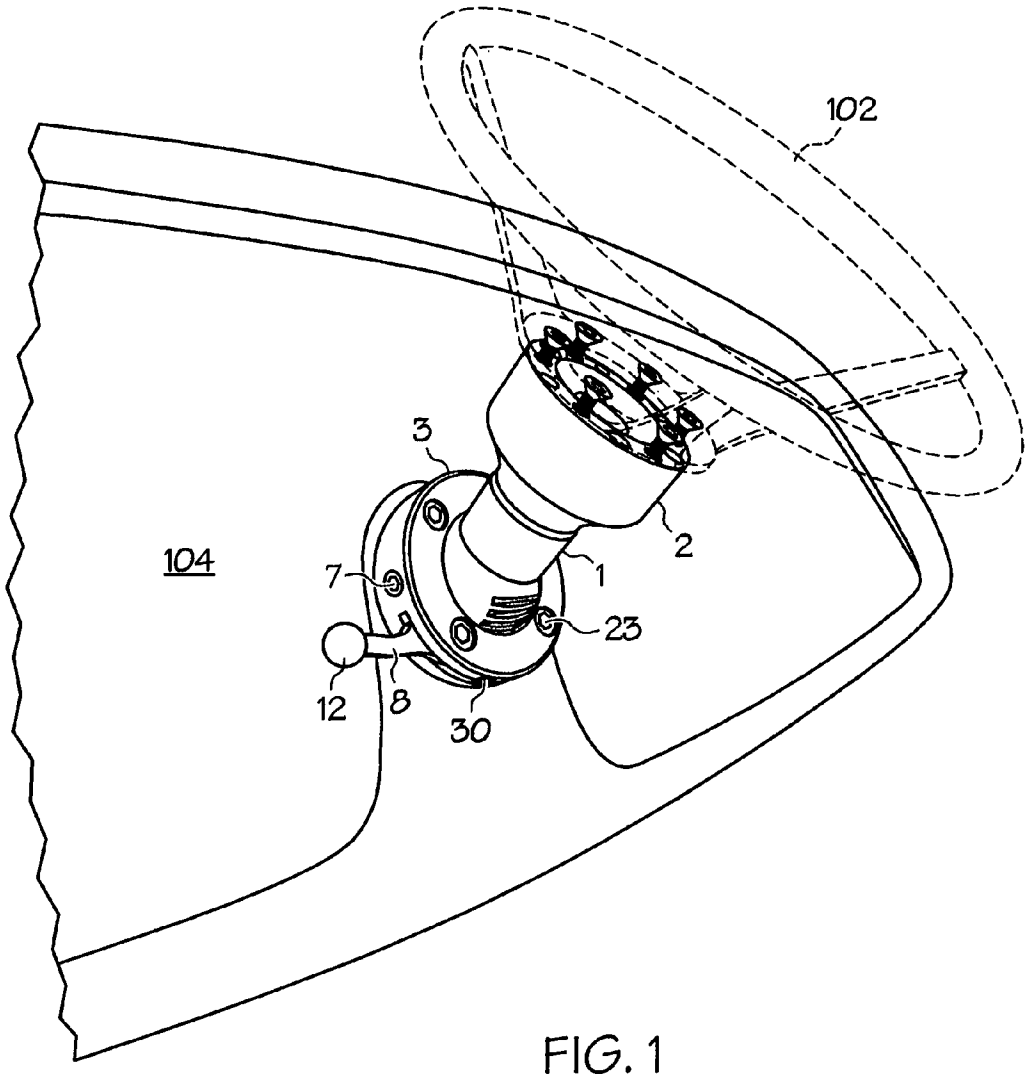
FIG. 1 is a perspective view of the tilt helm installed in the dashboard of a boat.
Figure 2:
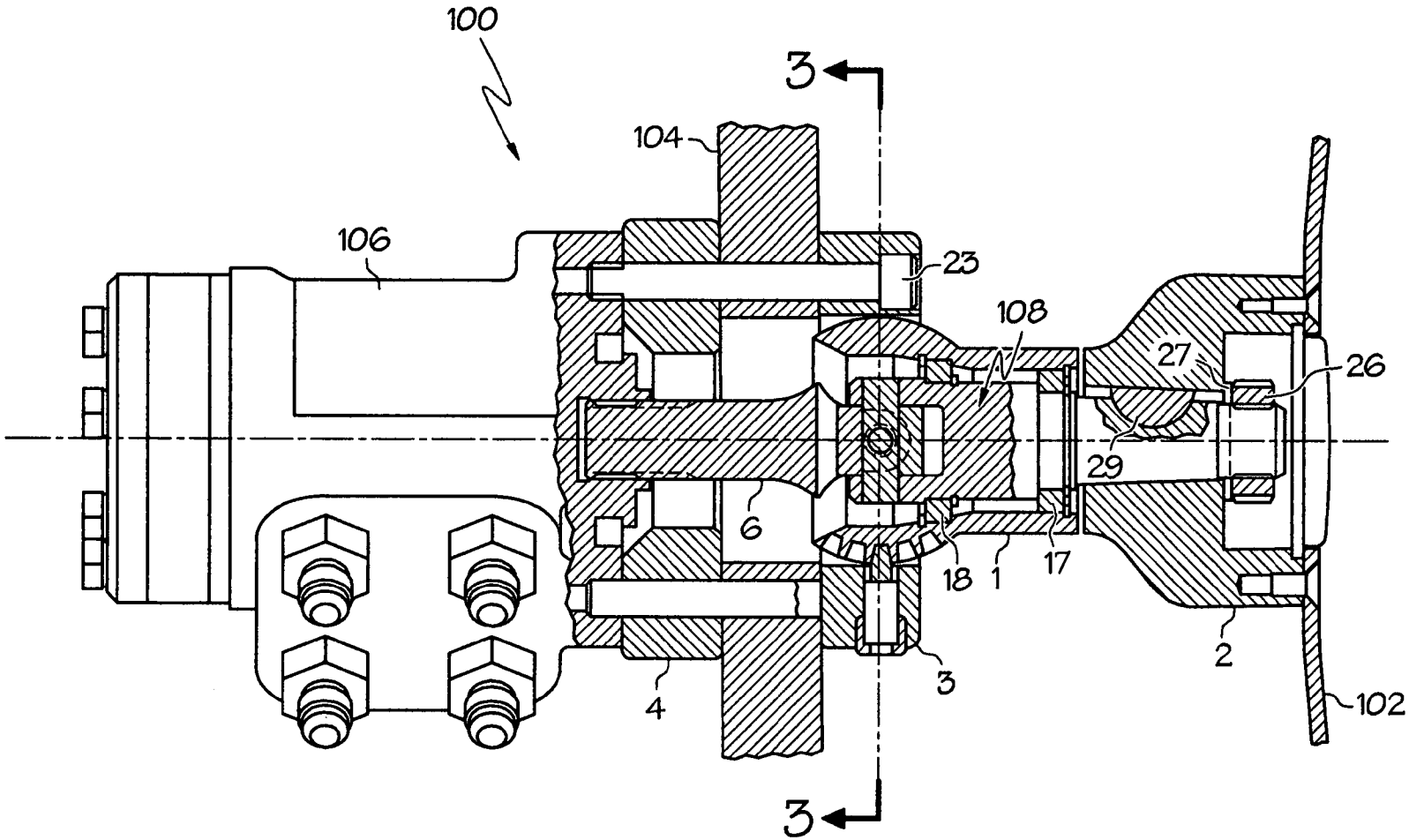
FIG. 2 is a longitudinal section view of the tilt helm of FIG. 1.
Figure 4:
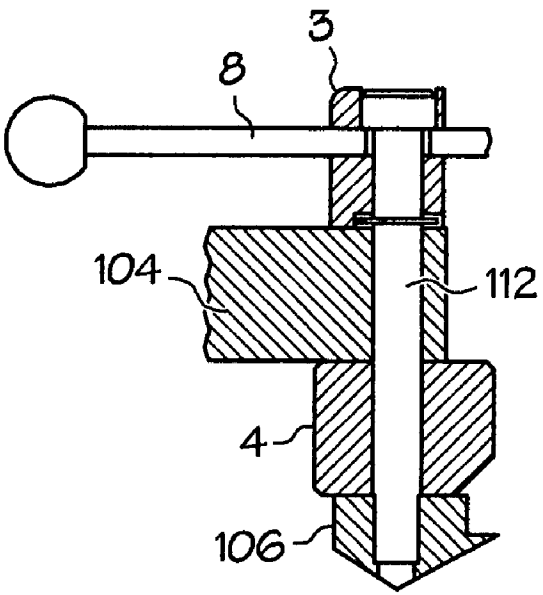
FIG. 4 is a section view taken along line 4-4 of FIG. 3.

The tilt helm of the present invention is indicated generally by the numeral 100 in the accompanying drawings. Tilt helm 100 allows the user to adjust the position of a steering wheel 102 with respect to a dashboard or other mounting surface 104. Tilt helm 100 provides the adjustment while not interfering with or taking away from the performance of steering wheel 102 or steering system 106. In the exemplary embodiment of the invention, steering system 106 is a hydraulic steering system that requires a rotational input from steering wheel 102. Tilt helm 100 allows the user to adjust the position of steering wheel 102 simply by moving a tilt locking lever 8 from an engaged position (shown in solid lines in FIG. 3) to a disengaged position (shown in dashed lines in FIG. 3). Tilt locking lever 8 is configured to interact with a bearing housing 1 to securely hold the selected position of steering wheel 102.

Tilt helm 100 generally includes a lever housing 3 adapted to be mounted to dashboard or mounting structure 104. A tilt locking lever 8 is carried by lever housing 3 in a manner that allows it to pivot between the engaged and disengaged positions. The bearing housing 1 is pivotably carried by lever housing 3 such that bearing housing 1 pivots about a horizontal axis. In the exemplary embodiment of the invention, bearing housing 1 may pivot through a 50 degree arc. Tilt helm 100 may optionally include a spacer 4 that is positioned between steering unit 106 and the rear surface of dashboard or support structure 104 to maintain the desired two inch spacing between the front surface of dashboard or support structure 104 and the front surface of steering unit 106. In other embodiments of the invention, this space may be maintained in other manners. Tilt helm 100 may also optionally include a steering wheel mount 2 that attaches steering wheel 102 to bearing housing 1. Tilt helm 100 also includes a universal steering column 108 that transfers the movement of steering wheel 102 to steering unit 106 in all of the potential positions of steering wheel 102. Steering column 108 is keyed to steering wheel mount 102 with an appropriate key 29. Column 108 is rotatably supported within bearing housing 1 by a pair of sealed ball bearing units 17 and 18. Column 108 is also held to steering wheel mount 2 by a jam nut 26 that engages a washer 27. The output end 6 of column 108 is directly splined to steering unit 106. The pivot center of universal steering column 108 is disposed on the same plane as the pivot axis of bearing housing 1. Bearing housing 1 is pivotably supported by a pair of pivot set screws 7 that have tapered inner ends 110. The tapered inner ends 110 of set screw 7 engage tapered bearings 28 and allow the tightness of the connection between bearing housing 1 and lever housing 3 to be adjusted by rotating pivot set screws 7.

Figure 7:
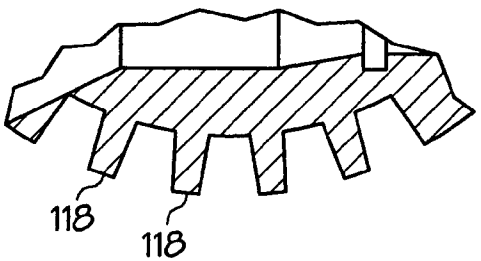
FIG. 7 is an enlarged view of the box labeled with the letter 7 in FIG. 5.
Figure 5:
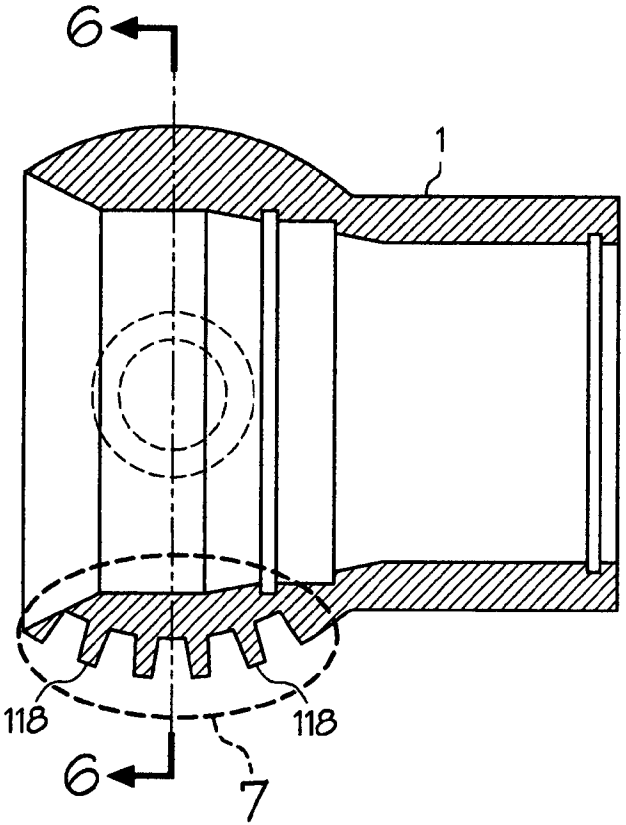
FIG. 5 is a section view of the bearing housing.
Figure 9:
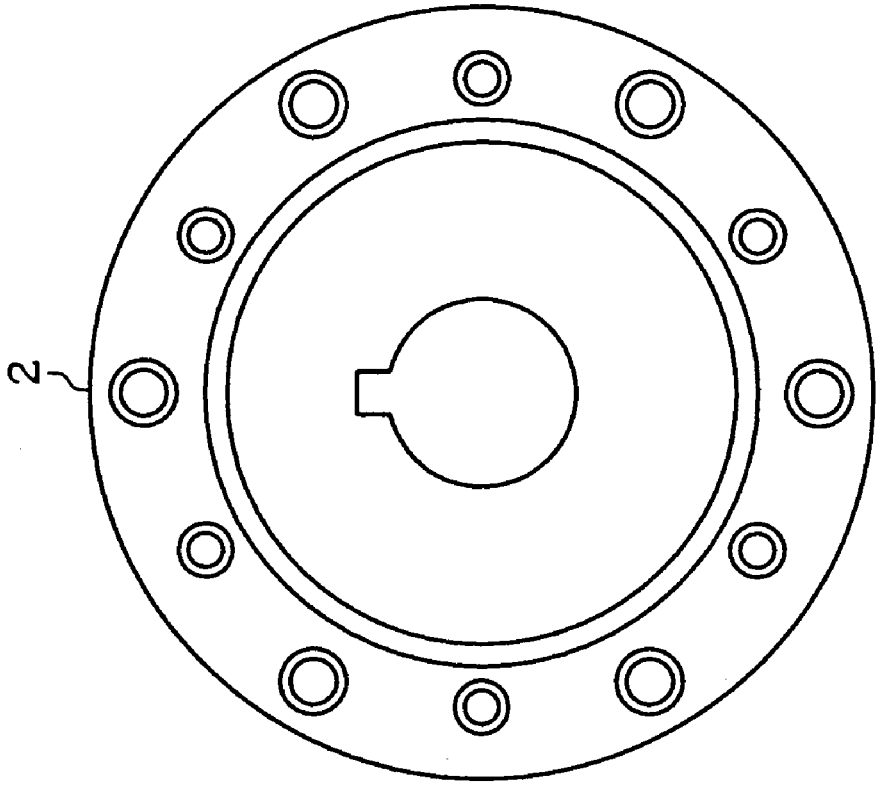
FIG. 9 is an end view of the steering wheel mount.
Figure 8:
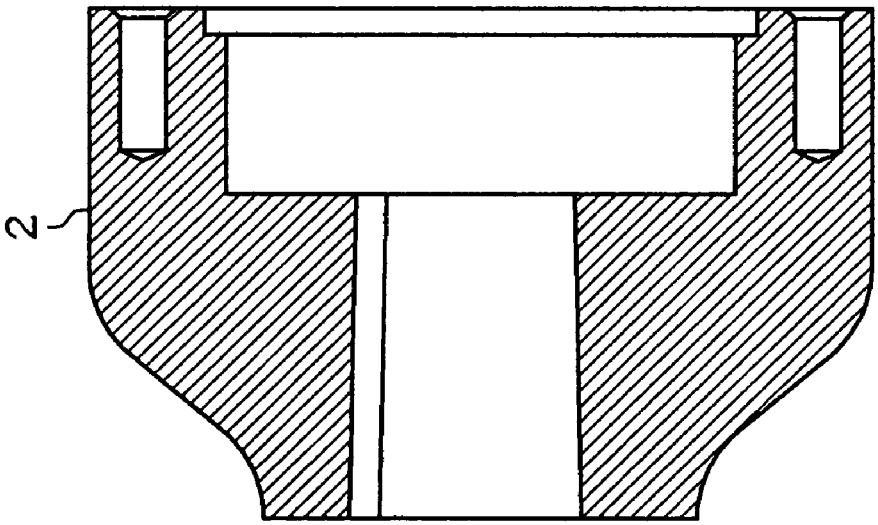
FIG. 8 is a section view of the steering wheel mount.
Figure 11:
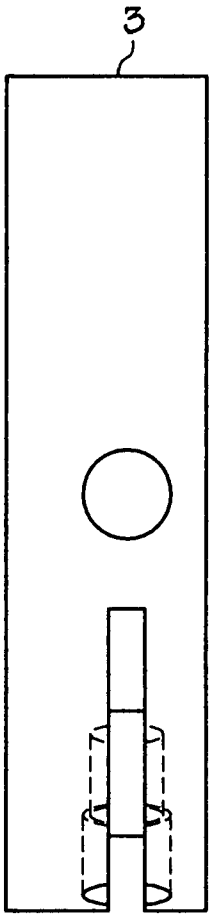
FIG. 11 is a side view of the lever housing.
Figure 10:
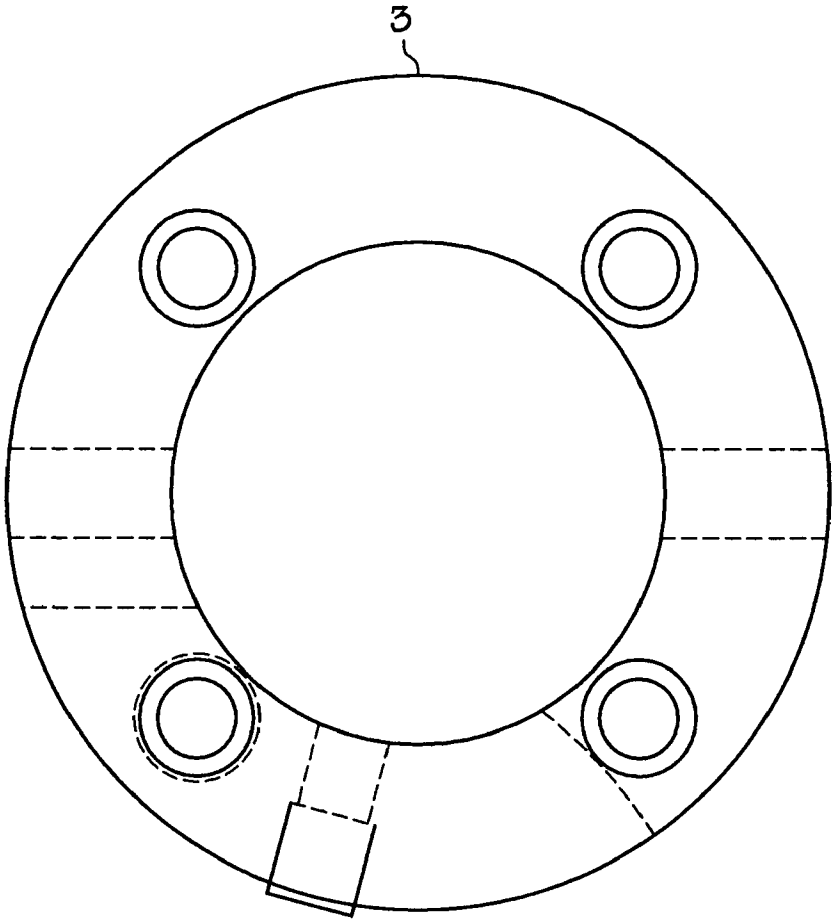
FIG. 10 is a front elevation view of the lever housing.
Figure 13:
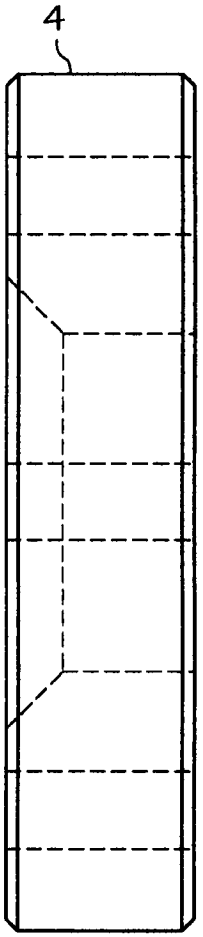
FIG. 13 is a side view of the spacer.
Figure 12:
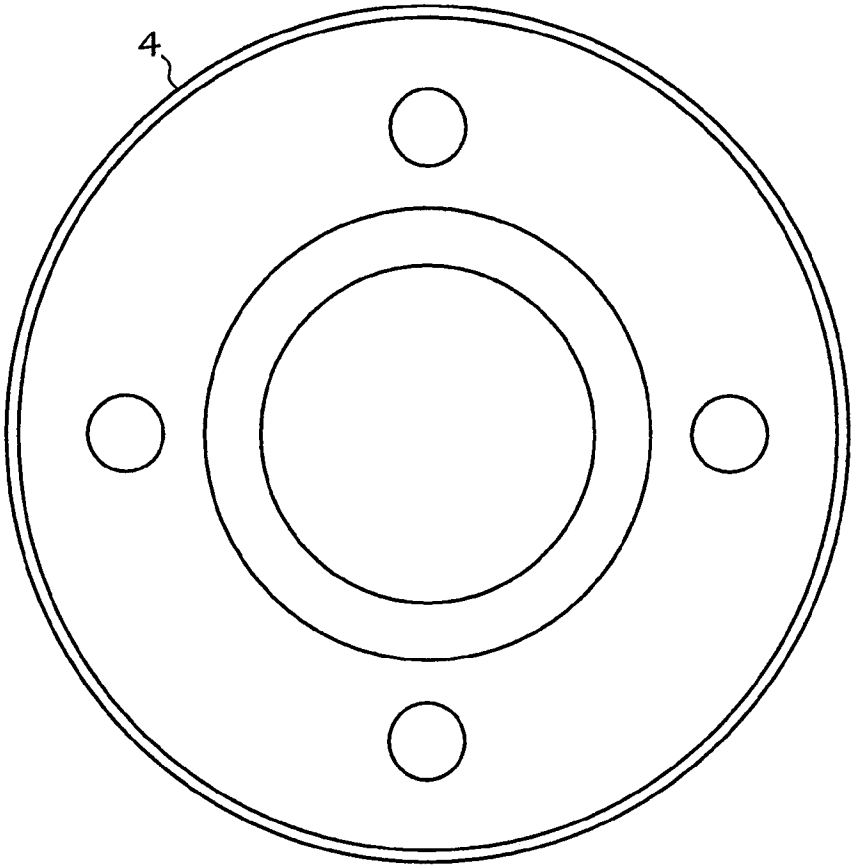
FIG. 12 is a front elevation view of the spacer.
Figure 15:
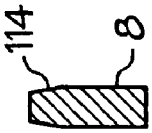
FIG. 15 is a section view taken along line 15-15.
Figure 14:
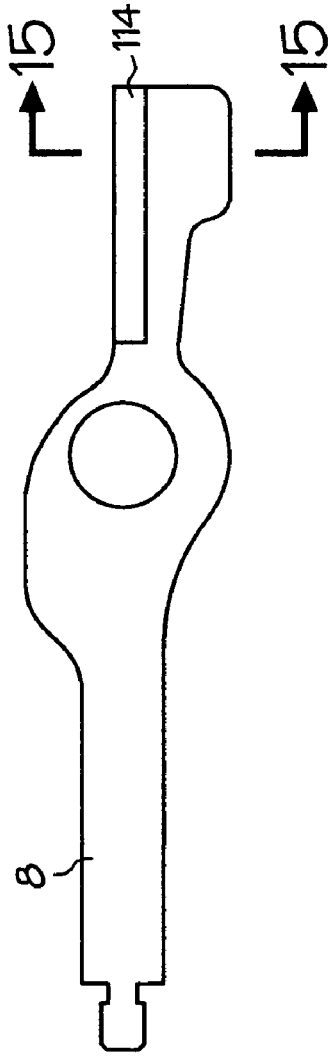
FIG. 14 is a front view of the tilt locking lever.
Figure 16:
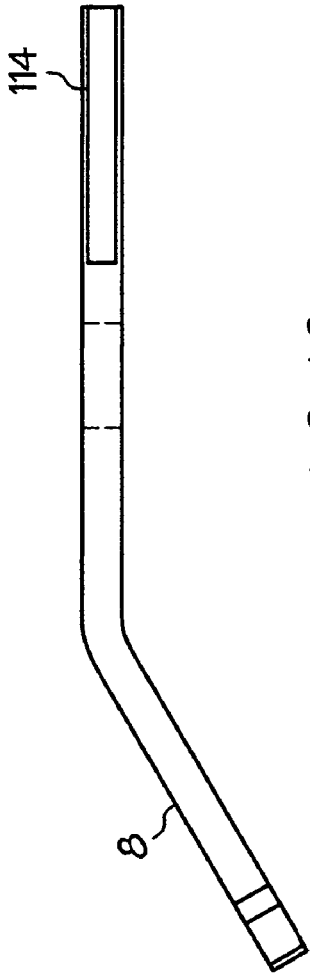
FIG. 16 is a top view of the tilt locking lever.

As discussed above, tilt helm 100 includes tilt locking lever 8 that is pivotably carried by lever housing 3 between engaged and disengaged positions. Tilt lock lever 8 pivots about an axis 112 that is disposed substantially perpendicular to the front surface of dashboard or support structure 104. The inner end of tilt lock lever 8 includes at least one tooth 114 (see FIGS. 14-16) that is configured to securely engage any one tooth 118 that is defined by bearing housing 1 as shown in FIGS. 5 and 7. Teeth 114 and 118 are preferably tapered to ensure a tight, rattle-free, secure fit with each other so that the person holding steering wheel 102 will not feel any play or looseness in steering wheel 102 while the boat is in use. Tapered teeth 114 and 118 also reduce friction between tilt lock lever 8 and bearing housing 1 that would cause undesirable wear in tilt helm 100. In the preferred embodiment of the invention, bearing housing 1 defines six teeth 118 thus providing five potential positions for steering wheel 102. In other embodiments of the invention, different numbers of teeth 118 may be provided as desired.

Figure 3:
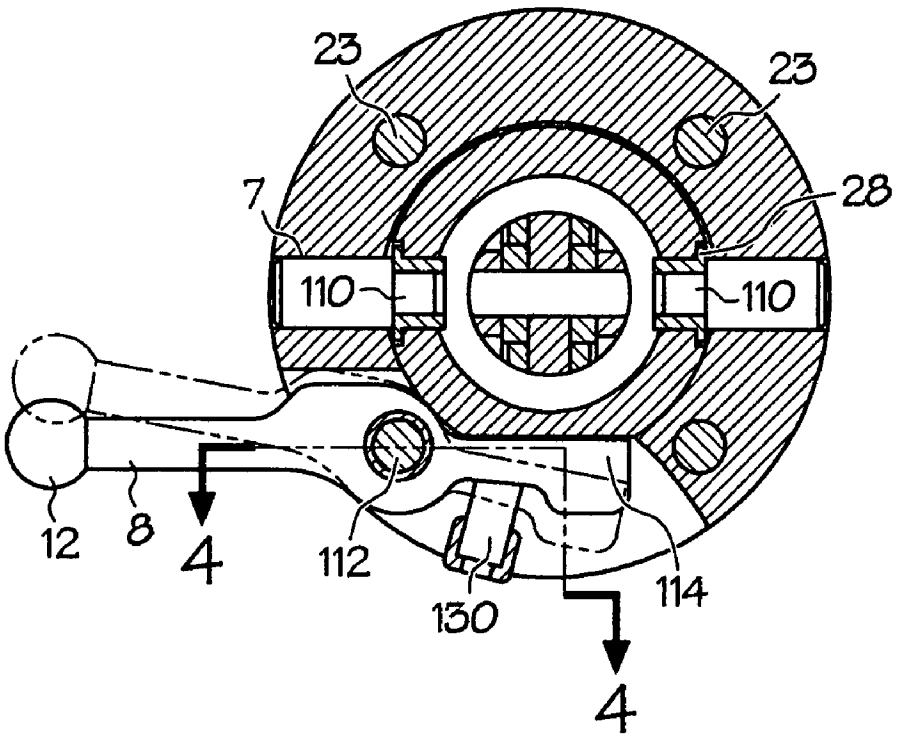
FIG. 3 is a section view taken along line 3-3 of FIG. 2.
Figure 6:
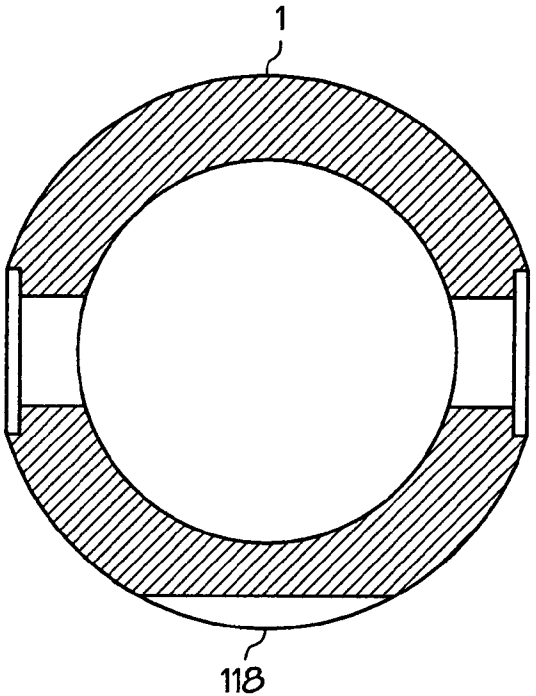
FIG. 6 is a section view taken along line A-A of FIG. 5.

As shown in FIG. 3, tilt lock lever 8 is biased to the engaged position with a spring 130 that has an inner end that directly engages lock lever 8 while an outer end directly engages lever housing 3 or a spring retainer 11 that engages lever housing 3. Spring 130 may be a coil spring that is entirely retained by lever housing 3 so that it is trapped between lock lever 8 and housing 3 thus eliminating the chance that spring 130 will become disengaged from lock lever 8 during operation of tilt helm 100. The position of lock spring 130 is important because a boat using tilt helm 100 may be traveling at high speeds across choppy water creating a significant amount of vibration and shock forces on tilt helm 100. The strength and security of lock lever 8 and locking spring 130 thus create a safety issue for tilt helm 100.

Tilt helm 100 also allows the end 12 of lock lever 8 to extend from housing 3 in a position that is accessible to the user of tilt helm 100. Lock lever 8 may be moved to the disengaged position with one hand while allowing the other hand to remain securely on steering wheel 102. Lock lever 8 and lever housing 3 may be configured to allow lock lever 8 to extend from either the left or right hand side of housing 3.

Lever housing 3 defines a bolt hole pattern that matches the hole pattern of steering unit 106 so that common bolts 23 may be used to mount tilt helm 100 to steering unit 106.

All of the elements of the tilt mechanism (except the bearings and bushings) may be fabricated from stainless steel. The stainless steel provides excellent corrosion resistance and provides the tilt helm with an attractive exterior appearance so that the visible elements of the tilt helm do not have to be covered.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A tilt helm for use with a boat having a dashboard and a steering system; the tilt helm comprising:

a first housing adapted to be mounted in a fixed position with respect to the dashboard;

a second housing having a plurality of outwardly-opening teeth; the second housing defining a through-bore adapted to receive a portion of the steering system of the boat;

the second housing pivotably mounted to the first housing about a first horizontal pivot axis;

a tilt locking lever pivotably carried by the first housing between engaged and disengaged positions; the tilt locking lever engaging the teeth of the second housing when the tilt locking lever is in the engaged position to prevent the second housing from pivoting with respect to the first housing when the tilt locking lever is in the engaged position; the teeth of the second housing being free of the tilt locking lever when the tilt locking lever is in the disengaged position to allow the second housing to pivot with respect to the first housing when the tilt locking lever is in the disengaged position;

the first housing defining an opening; a portion of the tilt locking lever being disposed in the opening of the first housing;

the tilt locking lever pivoting about a second pivot axis; the second pivot axis being disposed in a non-parallel orientation with respect to the first pivot axis; and a mounting bolt adapted to mount the first housing to the dashboard; the mounting bolt pivotably mounting the tilt locking lever to the first housing.

2. The tilt helm of claim 1, further comprising a spring biasing the tilt locking lever toward the engaged position; the spring disposed inside the first housing.

3. The tilt helm of claim 2, wherein the spring is a coil spring having one end that directly engages a portion of the tilt locking lever.

4. The tilt helm of claim 1, wherein the second pivot axis is perpendicular to the first pivot axis.

5. A tilt helm for use on a boat having a dashboard with a front surface; the tilt helm comprising:

a first housing adapted to be in a fixed position with respect to the dashboard; the housing being positioned outwardly of the front surface of the dashboard;

the first housing defining a central opening having a longitudinal axis disposed normal to a reference plane in which the first housing is disposed;

a second housing pivotably mounted to the first housing about a first pivot axis; the second housing a defining a longitudinal bore; the second housing having an outer surface that defines a plurality of teeth;

a portion of the second housing being disposed in the central opening of the first housing;

the second housing is mounted to the first housing with a pair of adjustable set screws; each of the set screws having a tapered inner end; the second housing carrying a pair of tapered bushings; the tapered inner end of each set screw being received in one of the tapered bushings carried by the second housing;

a tilt lock tooth selectively movable with respect to the first housing between engaged and disengaged positions; the tilt lock tooth engaging the teeth of the second housing when the tilt lock tooth is in the engaged position; the teeth of the second housing being free of the tilt lock tooth when the tilt lock tooth is in the disengaged position; and the tilt lock tooth moving perpendicular to the longitudinal axis of the central opening.

6. The tilt helm of claim 5, wherein the first housing defines a tooth opening that receives a portion of the tilt lock tooth when the tilt lock tooth is disengaged from the teeth of the second housing; the tooth opening being directly connected to the central opening of the first housing.

7. The tilt helm of claim 5, wherein the first housing carries the adjustable set screws and defines openings that allow the set screws to be adjusted while the first housing is mounted to the dashboard.

8. A tilt helm for use with a boat having a dashboard and a steering system; the tilt helm comprising:

a first housing adapted to be mounted in a fixed position with respect to the dashboard;

the first housing defining a central opening;

a second housing having a plurality of outwardly-opening teeth; the second housing defining a through-bore adapted to receive a portion of the steering system of the boat;

a portion of the second housing being disposed in the central opening of the first housing;

the second housing pivotably mounted to the first housing about a first horizontal pivot axis;

the second housing being mounted to the first housing with a pair of adjustable set screws; each of the set screws having a tapered inner end; the second housing carrying a pair of tapered bushings; the tapered inner end of each set screw being received in one of the tapered bushings carried by the second housing;

a tilt lock tooth selectively movable with respect to the first housing between engaged and disengaged positions; the tilt lock tooth engaging the teeth of the second housing when the tilt lock tooth is in the engaged position; the teeth of the second housing being free of the tilt lock tooth when the tilt lock tooth is in the disengaged position;

the first housing defining a tooth opening that is directly connected to the central opening of the first housing; and the tilt lock tooth extending through the tooth opening when the tilt lock tooth is engaged with the teeth of the second housing.

9. The tilt helm of claim 8, wherein the first housing carries the adjustable set screws and defines openings that allow the set screws to be adjusted while the first housing is mounted to the dashboard.

10. The tilt helm of claim 8, further comprising a spring that biases the tilt lock tooth toward the engaged position; the spring being disposed within the first housing.

11. The tilt helm of claim 10, wherein the spring is a coil spring having one end that directly engages a portion of the tilt lock tooth.

12. In combination on a boat:

a dashboard disposed at the location from where the steering of the boat is controlled, a tilt helm, a spacer, and a steering unit;

a plurality of mounting bolts;

each of the mounting bolts extending through the dashboard and through the spacer; each of the mounting bolts engaging the tilt helm and the steering unit to securely mount the tilt helm in place with respect to the steering unit; and further comprising a universal steering column having a pivot center; a portion of the universal steering column being disposed inside the tilt helm; the tilt helm having a pivot axis aligned with the pivot center of the universal steering column.

13. The combination of claim 12, wherein the tilt helm includes a lever housing adapted to be mounted in a fixed position with respect to the dashboard;

a bearing housing having a plurality of teeth;

the bearing housing pivotably mounted to the lever housing about a first pivot axis; the first pivot axis being disposed in a horizontal reference plane;

a tilt locking lever pivoting with respect to the lever housing between engaged and disengaged positions; the tilt lever engaging the teeth of the bearing housing when the tilt locking lever is in the engaged position to prevent the bearing housing from pivoting with respect to the lever housing when the tilt locking lever is in the engaged position; the teeth of the bearing housing being free of the locking lever when the locking lever is in the disengaged position to allow the bearing housing to pivot with respect to the lever housing when the tilt locking lever is in the disengaged position; and the locking lever being pivotably connected to the lever housing by one of the mounting bolts.

14. In combination on a boat:

a dashboard disposed at the location from where the steering of the boat is controlled, a tilt helm, a spacer, and a steering unit;

a plurality of mounting bolts;

each of the mounting bolts extending through the dashboard and through the spacer; each of the mounting bolts engaging the tilt helm and the steering unit to securely mount the tilt helm in place with respect to the steering unit;

wherein the tilt helm includes a first housing adapted to be mounted in a fixed position with respect to the dashboard;

a second housing having a plurality of outwardly-opening teeth; the second housing defining a through-bare adapted to receive a portion of the steering system of the boat;

the second housing pivotably mounted to the first housing about a first horizontal pivot axis;

a tilt lock tooth selectively movable with respect to the first housing between engaged and disengaged positions; the tilt lock tooth engaging the teeth of the second housing when the tilt lock tooth is in the engaged position; the teeth of the second housing being free of the tilt lock tooth when the tilt lock tooth is in the disengaged position;

the first housing defining a tooth opening that is directly connected to the central opening of the first housing; and the tilt lock tooth extending through the tooth opening when the tilt lock tooth is engaged with the teeth of the second housing.

15. In combination on a boat:

a dashboard disposed at the location from where the steering of the boat is controlled, a tilt helm, and a steering unit;

a plurality of mounting bolts;

each of the mounting bolts engaging the tilt helm and a portion of the steering unit to securely mount the tilt helm in place with respect to the portion of the steering unit; and a universal steering column having a pivot center; a portion of the universal steering column being disposed inside the tilt helm; the tilt helm having a pivot axis aligned with the pivot center of the universal steering column; the universal steering column including a universal joint that defines the pivot center of the universal steering column.

16. The system of claim 15, wherein the position of the steering unit is fixed with respect to the dashboard.

17. A boat steering system; comprising:

a steering unit;

a tilt helm having first and second housings; the first housing being a cylinder defining a cylindrical central opening; the second housing being at least partially disposed within the cylindrical central opening of the first housing; the second housing selectively pivotable with respect to the first housing about a first pivot axis; the first pivot axis passing through a portion of the first housing;

the second housing defining a plurality of teeth;

a tilt lock tooth pivotably mounted to the first housing between engaged and disengaged positions, the tilt lock tooth engaging the teeth of the second housing when the tilt lock tooth is in the engaged position; the teeth of the second housing being free of the tilt lock tooth when the tilt lock tooth is in the disengaged position;

the first housing defining a tooth opening that is directly connected to the central opening of the first housing;

the tilt lock tooth extending through the tooth opening when the tilt lock tooth is engaged with the teeth of the second housing;

a universal steering column having a front portion and a rear portion that are connected to each other with a universal joint that allows the front portion of the universal steering column to selectively pivot with respect to the steering unit; the position of the steering unit being fixed with respect to the first housing of the tilt helm; and the universal joint of the universal steering column being disposed inside the tilt helm.

18. The system of claim 17, wherein the rear portion of the universal steering column is directly connected to the steering unit.

19. A boat steering system; comprising:

a dashboard;

a tilt helm having first and second housings; the position of the first housing being fixed with respect to the dashboard; the second housing selectively pivotable with respect to the first housing about a first pivot axis;

a steering wheel;

a steering unit;

a plurality of mounting bolts;

a plurality of the mounting bolts engaging the first housing of the tilt helm and a portion of the steering unit to securely mount the first housing of the tilt helm in place with respect to the portion of the steering unit;

a universal steering column having a front portion and a rear portion that are connected to each other with a joint that allows the front portion of the universal steering column to selectively pivot with respect to the steering unit;

the front portion of the universal steering column being connected to the steering wheel;

the rear portion of the universal steering column being connected to the steering unit; and the joint of the universal steering column being disposed within the tilt helm.

* * * * *